US005837415A

United States Patent [19]

Uchida

[11] Patent Number: 5,837,415

[45] Date of Patent: Nov. 17, 1998

[54] ELECTROPHOTOGRAPHIC TONER

[75] Inventor: Tsuyoshi Uchida, Hachioji, Japan

[73] Assignee: Konica Corporation, Japan

[21] Appl. No.: 844,160

[22] Filed: Apr. 18, 1997

[30] Foreign Application Priority Data

Apr. 24, 1996 [JP] Japan ..... 8-102626

[51] Int. Cl.[6] ..... G03G 13/20; G03G 9/08

[52] U.S. Cl. ..... 430/109; 430/124

[58] Field of Search ..... 430/96, 106, 109

[56] References Cited

U.S. PATENT DOCUMENTS

| | | | |
|---|---|---|---|
| 5,501,931 | 3/1996 | Hirama et al. | 430/109 |
| 5,518,848 | 5/1996 | Ito et al. | 430/109 |
| 5,658,991 | 8/1997 | Kosaka et al. | 430/109 |

*Primary Examiner*—John Goodrow
*Attorney, Agent, or Firm*—Jordan B. Bierman; Bierman, Muserlian and Lucas

[57] ABSTRACT

An electrophotographic toner is disclosed. The toner comprises a low molecular weight component resin A essentially consisting of a styrene monomer unit or not less than 90% by weight of a styrene monomer unit and an acrylic acid or methacrylic acid monomer unit, a medium molecular weight component resin B comprising not more than 90% by weight of a styrene monomer unit and an acrylic acid ester monomer unit or a methacrylic acid ester monomer unit or not more than 90% by weight of a styrene monomer unit and an acrylic acid ester monomer unit or a methacrylic acid ester monomer unit and an acrylic acid or a methacrylic monomer unit, and a high molecular weight component resin C comprising not more than 90% by weight a styrene monomer unit and an acrylic acid ester monomer unit or a methacrylic acid ester monomer unit, and the glass transition point of component resin A, TgA, that of component resin B, TgB and that of component resin C, TgC, satisfy the following equations 1 and 2;

$$80^\circ\ C. \geqq TgA \geqq TgC \geqq TgB > 40^\circ\ C. \quad (1)$$

$$TgA \geqq 60^\circ\ C. \quad (2).$$

7 Claims, No Drawings

ELECTROPHOTOGRAPHIC TONER

FIELD OF THE INVENTION

This invention relates to an electrophotographic toner improved in the fixing ability thereof.

BACKGROUND OF THE INVENTION

In the electrophotographic imaging process, an electrostatic latent image is formed on the surface of an electrophotographic photoreceptor and the latent image is developed by adhering toner particles on the latent image by a developing means such as a magnetic brush. The developed toner image is transferred on a image receiving sheet and fixed on the surface of the image receiving sheet by thermally melting the toner by means of a fixing means such as a heating roller to form a permanent image.

Various properties are required to the toner used for electrophotography. Among them, many techniques have been proposed for the purpose of improvement of the fixing ability of the toner.

A binder resin for the toner having a wide molecular weight distribution within the range of Mw/Mn=3.5 to 40 is proposed in Japanese Patent 55-6895. The patent describes that both of a good fixing property and a high resistivity against hot-offset occurrence can be obtained by the toner composed of the binder resin. However, a toner according to this techniques is insufficient in the fixing ability and not suitable for a recent high speed copy machine.

A binder resin for toner composed of a high molecular weight polymer having a molecular weight of not less than 300,000 a low molecular weight polymer having a molecular weight of 1,000 to 30,000 and a medium molecular weight polymer having a molecular weight of 50,000 to 200,000 is disclosed in Japanese Patent Publication Open to Public Inspection (JP O.P.I.) No. 4-190224, and a toner composed of a binder having at least three peaks of molecular weight distribution within the range of $10^3$ to $10^7$ is disclosed in JP O.P.I. No. 1-221758. A toner having a good fixing ability can be obtained by these techniques. However, the molecular weight distribution in the binder is made too wide since the state of the molecular weight distribution of the resins in the toner is not controlled in these techniques.

As a result, the fixing ability is degraded and a problem that copy sheets piled in an exit tray are adhered with each other by the molten toner is caused when the copied images are formed on both sides of each the sheets by a duplex copying operation.

SUMMARY OF THE INVENTION

The object of the invention is to provide a toner for electrophotographic use and a method for fixing an electrophotographic toner image formed by the toner.

The object of the invention is attained by an electrophotographic toner comprising a low molecular weight component resin A essentially consisting of a styrene monomer unit or not less than 90% by weight of a styrene monomer unit and an acrylic acid or methacrylic acid monomer unit, a medium molecular weight component resin B comprising not more than 90% by weight of a styrene monomer unit and an acrylic acid ester monomer unit or a methacrylic acid ester monomer unit or not more than 90% by weight of a styrene monomer unit and an acrylic acid ester monomer unit or a methacrylic acid ester monomer unit and an acrylic acid or a methacrylic monomer unit, and a high molecular weight component resin C comprising not more than 90% by weight a styrene monomer unit and an acrylic acid ester monomer unit or a methacrylic acid ester monomer unit, and the glass transition point of component resin A, TgA, that of component resin B, TgB and that of component resin C, TgC, satisfy the following equations 1 and 2;

$$80^\circ\ C. \geqq TgA \geqq TgC \geqq TgB \geqq 40^\circ\ C. \quad (1)$$

$$TgA \geqq 60^\circ\ C. \quad (2).$$

It is preferred that Component resins B and C are each dispersed in Component resin A in a form of domain. The diameter of the domain is preferably 0.2 to 3 $\mu$m.

The image formed on an image receiving sheet is preferably fixed by a fixing method using a heating roller. By the method, an image receiving sheet carrying a toner image formed by the above-mentioned toner of the invention is transported through the gap of a heating roller and a pressure roller so that the toner image is contacted to the heating roller for thermally fixing the toner image by heating and compressing.

DETAILED DESCRIPTION OF THE INVENTION

In the electrophotographic toner of the invention, the binder resin comprises a low molecular weight component (Component resin A), a medium molecular weight component (Component resin B) and a high molecular weight component (Component resin C).

In the invention, the component resin A is a polymer having the maximum peak of molecular weight distribution measured by a gel permeation chromatography (GPC) within the range of molecular weight of 1,000 to 20,000.

Component resin B is a polymer having the maximum peak of molecular weight distribution measured by GPC within the range of the molecular weight of more than 20,000 to less than 200,000.

Component resin C is a resin having the maximum peak of the molecular weight distribution measured by GPC within the range of the molecular weight of 200,000 to 500,000.

In the toner of the invention, the component resin A comprises not less than 90% by weight of a styrene monomer unit. The component resin A may further comprises a acrylic or methacrylic acid monomer unit. The content of the acrylic or methacrylic acid monomer unit is preferably not more than 2% by weight. When the content of the styrene monomer unit is 90% by weight or more, the component resin A is immiscible with the component resins B and C and the component resins B and C are suitably dispersed in the component resin A. As a results, the adhesion of duplex printed copy sheets caused by fusion of toner images in a continuous duplex copy operation can be prevented.

The component resin B is a polymer comprising less than 90% by weight of a styrene monomer unit, and an acrylic or methacrylic acid ester monomer unit. The component resin B may further comprises an acrylic or methacrylic acid monomer unit. The content of the acrylic or methacrylic acid monomer unit is preferably not more than 3% by weight.

In the toner of the invention, the glass transition points of the component resin A, TgA, component resin B, TgB, and component resin C, TgC, satisfy the following equations (1) and (2).

$$80° C. \geqq TgA \geqq TgC \geqq Tg\ B \geqq 40° C. \quad (1)$$

$$TgA \geqq 60° C. \quad (2)$$

When TgA is not lower than 60° C., the adhesion of duplex print sheets caused by fusion of toner can be appropriately prevented, and when TgA is not higher than 80° C., a satisfactory fixing ability of the toner can be obtained since the component resin A is a thermally sensitive component.

The component resin B is a thermally stable component and contributes to improvement of fixing ability of the toner. Therefore, it is required that the relation of TgA>TgC≧TgB is satisfied. When TgB is less than 40° C., the adhesion of duplex print sheets caused by fusion of the toner in the continuous duplex copying operation tends to be occurred.

The component resin C is a component contributing to prevention of the offset and the fixing ability of the toner is degraded when TgC is higher than TgA. When TgC is lower than TgB, the adhesion of the duplex copy sheets in the continuous duplex copying operation tends to be occurred.

It is preferable that the component resin B and the component resin C are each dispersed in the component resin A in a form of domains. The diameter of the domain is preferably 0.2 μm to 3 μm.

It is found by the inventors that the toner can obtain a high fixing ability when the component resins B and C which are high viscous components, are not completely mingled with the component resin A which is a low viscous component, and dispersed in the component resin A forming the domains having a domain diameter of not less than 0.2 μm. The domain diameter is preferably not more than 3 μm for preventing the adhesion of the duplex copy sheets caused by fusion of the toner in the continues duplex copying operation.

The domain diameter is determined by the following method.

A piece of binder resin is sliced by a microtome to a slice of 20 nm. The sliced sample is set in a transmission electron microscope and photographed with a magnification of 5,000 times. Thus obtained image is analyzed to measure the domain diameter.

In the toner of the invention, it is preferred that Component resin A accounts for 50 to 60% by weight in the binder resin. When the content of Component resin A is less than 50% by weight, the fixing ability of the toner is degraded, and when the content of Composition A exceeds. 60% by weight, the offset tends to be occurred.

It is preferred that the component resin B accounts for 10 to 25% by weight of the binder resin. The content of the component resin B of less than 10% tends to cause the adhesion of the copy papers in the continuous duplex copying operation. When the content of the component resin B exceeds 25% by weight, the fixing ability of the toner tends to be degraded.

It is preferred that Component resin C accounts for 15 to 30% by weight of the binder resin. When the content of Component resin C is less than 15% by weight, the offset is occurred, and the content exceeding 30% by weight caused degradation in the fixing ability of the toner.

The glass transition point of the component resin is determined by the following method. In an aluminum pan, 5 mg of a component resin is weighed and sealed. The sample is heated from 0° C. to 200° C. in a rate of 10° C./min. and stood for 3 minutes at 200° C. After the standing, the sample is cooled to 0° C. in a rate of 10° C./min. Then the sample is heated to 200° C. to obtain a calorimetric curve. The glass transition point is defined by the temperature of the cross point of the base line of the calorimetric curve and a tangent through the point at which the calorimetric curve shows the maximum inclination between the leading edge and the endothermic peak of the calorimetric curve. A differential scanning calorimeter DSC-7 manufactured by Perkin-Elmer Co. is used for determining the calorimetric curve.

In the component resins of the invention, the following monomers are preferably usable.

A vinyl copolymer resin having a monomer unit of styrene and/or acrylate or methacrylate and methacrylic acid or methacrylic acid as a component having a carboxyl group in the side chain thereof is usable.

Examples of the styrene monomer include styrene, o-methylstyrene, m-methylstyrene, p-methylstyrene, α-methylstyrene, p-ethylstyrene, 2,3-dimethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, n-methoxystyrene, p-phenylstyrene, p-chlorostyrene and 3,4-dichlorostyrene.

Examples of acrylate monomer and methacrylate monomer include an alkyl acrylate and alkyl methacrylate such as methyl acrylate, ethyl acrylate, propyl acrylate, n-butyl acrylate, iso-butyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, iso-butyl methacrylate, n-octyl methacrylate, dodecyl methacrylate, 2-ethylhexyl methacrylate and stearyl methacrylate, 2-chloroethyl acrylate, phenyl acrylate, methyl α-chloroacrylate, phenyl methacrylate, dimethylaminophenyl methacrylate, dimethylaminoethyl methacrylate and diethylaminoethyl methacrylate. Among them, an alkyl ester of acrylic acid or methacrylic acid such as ethyl acrylate, propyl acrylate, n-butyl acrylate, ethyl methacrylate, and n-butyl methacrylate, particularly, n-butyl acrylate, methyl methacrylate and n-butyl methacrylate are preferable.

Acrylic acid and methacrylic acid are preferable as the Acrylic acid and methacrylic acid monomers.

For the polymerization of the foregoing styrene-acryl components, a solution polymerization, suspension polymerization, emulsion polymerization and bulk polymerization are applicable. Among them, the solution polymerization and suspension polymerization are preferable.

It is preferred in the binder resin of the toner that Component resin B or Component resins A and B contain an acrylic acid monomer as the constituent unit thereof. The fixing ability of the toner is improved when the acrylic acid is contained in Component resin B or Component resins A and B as the constituent unit thereof.

It is preferred that the acid value of the binder resin to be used in the toner of the invention is preferably 0.1 to 10. When the acid value is less than 0.1 the effect on the improvement of the fixing ability is decreased. When the acid value exceeds 10, the electrostatic charge of the toner tends to become instable. The acid value is the amount of potassium hydroxide in milligram necessary to neutralize a free acid and fatty acid contained in the binder resin. The acid value is determined by the following method.

In 75 ml of toluene, 2 gram of the sample of a resin is dissolved, and 25 ml of a neutralized mixture of methanol and acetone in a ratio of 1:1 is added to the solution. Then the solution is subjected to potentiometric titration with a 0.1N alcoholic solution of KOH. The acid value is determined by the following equation based on the volume, X ml, of the KOH solution at the inflection point of the titration curve.

Acid value (KOH mg/g Resin)=5.16×$X$/2

The binder resin is prepared by mixing and heating the component resin C, the component resin B and the component resin A in an organic solvent in which the component resins can be dissolved. Then the solvent is removed from the mixture to prepare the binder. As the solvent, benzene, toluene, xylene and cumene are preferably usable. It seems that the domain diameter of the component resin B or C in the component resin A is determined by the difference of the viscosity of each of the component.

The binder resin can be used for both of a non-magnetic toner and a magnetic toner. The toner of the invention is prepared by the following manner.

The binder resin, a colorant, and according to necessity, a wax, a magnetic powder are blended under a dry condition. The mixture is fused and kneaded by an extruder, a kneader, a kneading roller machine or a closed mixer so that the above-mentioned materials are uniformly mixed and chilled. After chilling, the mixture is crashed to fine powder and classified. The classified particles of the toner is blended under a dry condition with an external additive such as silica and a cleaning aids if necessary to prepare the toner.

In the toner of the invention, a wax may be contained. As the wax preferably to be contained in the toner, a low molecular weight polyolefin such as polypropylene and polyethylene and its derivative, alkylenebisfatty acid amide compound and a paraffin wax and a combination thereof are preferably usable. The adding amount of the wax is usually 1 to 20 parts, particularly 2 to 15 parts, par 100 parts by weight of the binder resin.

When the toner of the invention is used as a magnetic toner, a magnetic material is added to the toner particles. The magnetic material usable in the magnetic toner includes an iron oxide such as magnetite, hematite and ferrite, a metal such as iron nickel and cobalt, and an alloy of such the metal with aluminum, cobalt, copper, lead, magnesium, tin, zinc, antimony, beryllium, bismuth, cadmium, calcium, manganese selenium, titanium, tungsten or vanadium.

The toner may optionally contain a colorant. As the colorant, carbon black, nigrosine dye, aniline blue, chalcoil blue, chromium yellow, ultramarine blue, du Pont oil red, orient oil red, quinoline yellow, methylene blue chloride, phthalocyanine blue, malachite green oxalate, lamp black and rose bengal are cited.

The fixing means to be used in the toner fixing method of the invention is a heat roller fixing device having a heating roller and a pressure roller. In the method of the invention, a sheet carrying the image formed by the toner of the invention is transported between the heating roller and the compression roller and thermally fixed by contacting to the heat roller.

The heat roller fixing device is preferably composed of an upper roller and a lower roller composed of silicone rubber. The upper roller comprises a cylinder of a metal such as iron or aluminum covered with a layer of tetrafluoroethylene or polytetrafluoroethylene-perfluoroalkoxyvinyl ether copolymer and a heat source inserted inside the cylinder. In detail, the heat source is preferably a line-shaped heater by which the roller is heated so that the surface temperature of the roller is raised by approximately 120° to 200° C. In the fixing portion, a pressure is applied to the upper and lower rollers so as to form a nip by deformation of the lower roller. The width of the nip is preferably 1 to 10 mm, more preferably 1.5 to 7 mm. The line speed of fixing is preferably 40 mm/sec. to 400 mm/sec. When the width of the nip is too narrow, the sheet carrying the toner image cannot be smoothly transported through the nip and the toner image hardly be uniformly fixed. When the nip width is too wide, the fusion of the toner is accelerated and the offset is excessively occurred.

A mechanism for cleaning the fixing device may optionally be attached to the heat fixing device. In such the case, a method of supplying a silicone oil on the upper roller or a film or a method of cleaning by a pad roller web soaked in a silicone oil. As the silicone oil, one having a high heat resistivity is preferably used. The silicone oil having a viscosity of 1,000 to 10,000 cps is preferably used since the outflow of the silicone oil is become excessive when the viscosity is too low.

EXAMPLE

Although the present invention is described in detail according to examples, the embodiment of the invention is not limited thereto.

Preparation of example binder resin 1 of the invention

Fifty five parts by weight of a component resin A composed of 99 parts by weight of styrene monomer unit and 1 part by weight of acrylic acid monomer unit and having the maximum peak of molecular weight distribution at 3,800 and a glass transition point of 64° C., 20 parts by weight of a component resin B composed of 71 parts by weight of styrene monomer unit, 27 parts by weight of n-butyl acrylate monomer unit and 2 parts by weight of acrylic acid monomer unit and having the maximum peak of molecular weight distribution at 110,000 and a glass transition point of 50° C., and 25 parts by weight of a component resin C composed of 80 parts by weight of styrene monomer unit and 20 parts by weight of n-butyl acrylate monomer unit and having the maximum peak of molecular weight distribution at 650,000 and a glass transition point of 60° C. were dissolved and mixed in xylene at 135° C. The mixture was dried under a reduced pressure to obtain example binder resin 1. It was observed by a transmission electron microscope that the component resins B and C were each dispersed in the component resin A forming domains having a diameter of 0.25 to 2.8 $\mu$m. The acid value of the binder resin was 7.1 mg KOH per gram of the resin.

Preparation of example binder resin 2 of the invention 55 parts by weight of a component resin A composed of styrene monomer unit and having the maximum peak of molecular weight distribution at 4.400 and a glass transition point of 67° C., 20 parts by weight of a component resin B composed of 71 parts by weight of styrene monomer unit, 27 parts by weight of n-butyl acrylate monomer unit and 2 parts by weight of acrylic acid monomer unit and having the maximum peak of molecular weight distribution at 100,000 and a glass transition point of 50° C., and 25 parts by weight of a component resin C composed of 70 parts by weight of styrene monomer unit and 30 parts by weight of n-butyl acrylate monomer unit and having the maximum peak of molecular weight distribution at 750,000 and a glass transition point of 50° C. were dissolved and mixed in xylene at 135° C. The mixture was dried under a reduced pressure to obtain example binder resin 2. It was observed by a transmission electron microscope that the component resins B and C were each dispersed in the component resin A forming domains having a diameter of 0.22 to 2.5 $\mu$m. The acid value of the binder resin was 2.9 mg KOH per gram of the resin.

Preparation of example binder resin 3 of the invention

Sixty parts by weight of a component resin A composed of styrene monomer unit and having the maximum peak of molecular weight distribution at 4,100 and a glass transition point of 65° C., 15 parts by weight of a component resin B composed of 65 parts by weight of styrene monomer unit, 33 parts by weight of n-butyl acrylate monomer unit and 2 parts by weight of acrylic acid and having the maximum peak of molecular weight distribution at 100,000 and a glass transition point of 50° C., and 25 parts by weight of a component resin C composed of 70 parts by weight of styrene monomer unit and 30 parts by weight of n-butyl acrylate monomer unit and having the maximum peak of molecular weight distribution at 750,000 and a glass transition point of 50° C. were dissolved and mixed in xylene at 135° C. The mixture was dried under a reduced pressure to obtain example binder resin 3. It was observed by a transmission electron microscope that the component resins B and C were each dispersed in the component resin A forming domains having a diameter of 0.22 to 2.5 μm. The acid value of the binder resin was 3.1 mg KOH per gram of the resin.

Preparation of comparative binder resin 1

Fifty five parts by weight of a component resin A composed of 99 parts by weight of styrene monomer unit and 1 part by weight of acrylic acid monomer unit and having the maximum peak of molecular weight distribution at 2,900 and a glass transition point of 55° C., 20 parts by weight of a component resin B composed of 71 parts by weight of styrene monomer unit, 27 parts by weight of n-butyl acrylate monomer and 2 part by weight of acrylic acid unit and having the maximum peak of molecular weight distribution at 110,000 and a glass transition point of 50° C., and 25 parts by weight of a component resin C composed of 80 parts by weight of styrene monomer unit and 20 parts by weight of n-butyl acrylate monomer unit and having the maximum peak of molecular weight distribution at 650,000 and a glass transition point of 60° C. were dissolved and mixed in xylene at 135° C. The mixture was dried under a reduced pressure to obtain comparative binder resin 1. It was observed by a transmission electron microscope that the component resins B and C were each dispersed in the component resin A forming domains having a diameter of 0.25 to 2.8 μm. The acid value of the binder resin was 4.1 mg KOH per gram of the resin.

Preparation of comparative binder resin 2

Sixty parts by weight of a component resin A composed of styrene monomer unit and having the maximum peak of molecular weight distribution at 3,000 and a glass transition point of 57° C., 15 parts by weight of a component resin B composed of 68 parts by weight of styrene monomer unit, 30 parts by weight of n-butyl acrylate monomer unit and 2 parts by weight of acrylic acid monomer unit and having the maximum peak of molecular weight distribution at 110,000 and a glass transition point of 48° C., and 25 parts by weight of a component resin C composed of 80 parts by weight of styrene monomer unit and 20 parts by weight of n-butyl acrylate monomer unit and having the maximum value of molecular weight distribution at 650,000 and a glass transition point of 60° C. were dissolved and mixed in xylene at 135° C. The mixture was dried under a reduced pressure to obtain comparative binder resin 2. It was observed by a transmission electron microscope that the component resins B and C were each dispersed in the component resin A forming domains having a diameter of 0.22 to 2.2 μm. The acid value of the binder resin was 2.2 mg KOH per gram of the resin.

Preparation of comparative binder resin 3

Seventy parts by weight of a component resin A composed of 85 parts by weight of styrene monomer unit and 15 part by weight of butyl acrylate monomer unit and having the maximum peak of molecular weight distribution at 10,000 and a glass transition point of 55° C., and 30 parts by weight of a component resin C composed of 80 parts by weight of styrene monomer unit and 20 parts by weight of n-butyl acrylate monomer unit and having the maximum peak of molecular weight distribution at 500,000 and a glass transition point of 60° C. were dissolved and mixed in xylene at 135° C. The mixture was dried under a reduced pressure to obtain comparative binder resin 3. It was observed by a transmission electron microscope that no domain of the component resin C was formed. The acid value of the binder resin was 1 mg KOH per gram of the resin. The acid value of the binder resin was 2.2 mg KOH per gram of the resin.

Preparation of comparative binder resin 4

Seventy parts by weight of a component resin A composed of 99 parts by weight of styrene monomer unit and 1 part by weight of acrylic acid monomer unit and having the maximum peak of molecular weight distribution at 3,600 and a glass transition point of 61° C., and 30 parts by weight of a component resin C composed of 80 parts by weight of styrene monomer unit and 20 parts by weight of n-butyl acrylate monomer unit and having the maximum peak of molecular weight distribution at 650,000 and a glass transition point of 60° C. were dissolved and mixed in xylene at 135° C. The mixture was dried under a reduced pressure to obtain comparative binder resin 4. It was observed by a transmission electron microscope that the component resin C was dispersed in the component resin A forming domains having a diameter of 0.4 to 6.0 μm. The acid value of the binder resin was 5.2 mg KOH per gram of the resin.

Preparation of Example Toner 1

In a double-roll kneading machine, 100 parts by weight Of the foregoing example binder resin 1 of the invention, 10 parts by weight of carbon black and 4 parts by weight of a polypropylene wax were molten and kneaded. The mixture was crashed by a jet mill after the kneading and classified by a wind classifying machine to obtain a toner composition having a volume average diameter of 8.5 μm. To 100 parts by weight of thus obtained toner composition, 1 parts by weight of hydrophobic silica added and mixed in a dry mixer. Thus Example Toner 1 of the invention was prepared.

Preparation of Example Toners 2 and 3

Example Toners 2 and 3 of the invention were each prepared in the same manner as in Example Toner 1 except that the Example Binder Resin 1 was replaced by the example binder resins 2 and 3, respectively.

Preparation of Comparative Toners 1 to 4

Comparative Toners 1 to 4 were each prepared in the same manner as in Example Toner 1 except that the example binder resin 1 was replaced by the comparative binder resins 1 to 4, respectively.

(Evaluation of the toners)

For evaluation of the properties of the toners in the practical use, seven kinds of electrophotographic developers were prepared each by mixing 6 parts by weight of each of the foregoing Example Toners 1 to 3 and Comparative Toners 1 to 4 was mixed with 100 parts by weight of a magnetic carrier coated with a fluorinated acrylate resin having a volume average diameter of 65 μm.

The developers were evaluated with respect to the following evaluation items 1 to 3. Results of the evaluation were listed in Table 1.

(1) Fixing ability

A copy image was prepared by a Copy Machine 3135 manufactured by Konica Corp. in which the fixing device was modified as follows. The surface of the copy image was rubbed by a cotton cloth. The reflex density of the image was measured before and after the rubbing by the cotton cloth to determine the fixing ratio. The fixing ratio is determined by the equation of Reflex density before rubbing/Reflex density after rubbing. The toner showing fixing ratio of less than 70% is not acceptable for practical use.

The fixing device used in the evaluation has an upper roller composed of a hollow iron cylindrical roller of diameter of 40 mm which is covered with a layer of tetrafluoroethylene-perfluoroalkylvinyl ether copolymer and a heater is provided in the center thereof, and a lower roller of diameter of 40 mm which is composed of silicone rubber and is covered with a layer of tetrafluoroethylene-perfluoroalkylvinyl ether copolymer. The line pressure applied between these rollers was 1.0 kg/cm and the nip width was 5.0 mm. The transportation line speed was 270 mm/sec. and the temperature of the upper roller was 160° C. No cleaning mechanism was attached.

(2) Resistivity against hot offset

By the foregoing copying machine, 100 sheets of copy were continuously prepared, and the occurrence of offset was visually judged. The samples were ranked to A and B according to the following norm.

A: No offset was observed

B: Occurrence of offset was observed

The fixing device used in the evaluation was the same as in the above evaluation of fixing ability except that the transportation line speed and the temperature of the upper roller were changed to 180 mm/sec. and 200° C., respectively.

(3) Adhesion caused by fusion of toner

By the foregoing copying machine, 500 sheets of copy were continuously prepared, and the occurrence of adhesion was visually observed. The samples were ranked to A and B according to the following norm.

A: No adhesion was observed

B: Occurrence of adhesion was observed

The fixing device used in the evaluation was the same as in the above evaluation of fixing ability except that the transportation line speed and the temperature of the upper roller were changed to 230 mm/sec. and 200° C., respectively.

TABLE 1

| Sample | Fixing ability | Adhesion | Offset | Note |
|---|---|---|---|---|
| Example 1 | 75% | A | A | Inventive |
| Example 2 | 77% | A | A | Inventive |
| Example 3 | 80% | A | A | Inventive |
| Comparative 1 | 82% | B | A | Comparative |
| Comparative 2 | 80% | B | A | Comparative |
| Comparative 3 | 60% | A | A | Comparative |
| Comparative 4 | 77% | B | A | Comparative |

As is shown in Table 1, the toners of the invention are superior to the comparative toners in all the evaluated properties.

What is claimed is:

1. An electrophotographic toner comprising a lower molecular weight component resin A essentially consisting of a styrene monomer unit of not less than 90% by weight of a styrene monomer unit and an acrylic acid or methacrylic acid monomer unit, a medium molecular weight component resin B comprising not more than 90% by weight of a styrene monomer unit, and an acrylic acid ester monomer unit or a methacrylic acid ester monomer unit, and an acrylic acid or a methacrylic acid monomer unit, and a high molecular weight component resin C comprising not more than 90% by weight of a styrene monomer unit and an acrylic acid ester monomer unit or a methacrylic acid ester monomer unit, and a glass transition point of component resin A, TgA, that of component resin B, TgB and that of component resin C, TgC, satisfy the following equations 1 and 2;

$$80^\circ\ C. \geqq TgA \geqq TgC \geqq TgB \geqq 40^\circ\ C. \quad (1)$$

$$TgA \geqq 60^\circ\ C. \quad (2).$$

2. The toner of claim 1, wherein the content of the acrylic acid monomer unit or the methacrylic acid monomer unit in the component resin A is more than 2% by weight.

3. The toner of claim 1, wherein the content of the acrylic acid monomer unit or the methacrylic acid monomer unit in the component resin B is more than 3% by weight.

4. The toner of claim 1, wherein the component resin B and the component resin C are each dispersed in the component resin A forming in a form of domain.

5. The toner of claim 4, wherein the diameter of domain of the component resins B and C are each 0.2 to 3 $\mu$m.

6. The toner of claim 1, wherein the molecular weight distribution of the component resin A has the maximum peak within the range of the molecular weight of 1,000 to 20,000, the molecular weight distribution of the component resin B has the maximum peak within the range of the molecular weight of more than 20,000 to less than 200,000, and the molecular weight distribution of the component resin C has the maximum peak within the range of 200,000 to 500,000.

7. The toner of claim 1, wherein the component resin A accounts for 50% to 60% by weight, the component resin B accounts for 10% to 25% by weight and the component resin C accounts for 15% to 30% by weight in the binder resin.

* * * * *